US005715982A

United States Patent [19]

Adachi

[11] Patent Number: 5,715,982

[45] Date of Patent: Feb. 10, 1998

[54] SAFETY MECHANISM FOR NAILING MACHINE

[75] Inventor: Michiaki Adachi, Tokyo, Japan

[73] Assignee: Max Co., Ltd., Tokyo, Japan

[21] Appl. No.: 657,902

[22] Filed: Jun. 7, 1996

[30] Foreign Application Priority Data

Jun. 9, 1995 [JP] Japan ..... 7-168205

[51] Int. Cl.[6] ..... B25C 1/04

[52] U.S. Cl. ..... 227/8; 227/130; 227/142

[58] Field of Search ..... 227/8, 142, 130

[56] References Cited

U.S. PATENT DOCUMENTS

| | | | |
|---|---|---|---|
| 4,767,043 | 8/1988 | Canlas, Jr. | 227/8 |
| 5,219,110 | 6/1993 | Mukoyama | 227/8 |
| 5,261,587 | 11/1993 | Robinson | 227/8 |
| 5,385,286 | 1/1995 | Johnson, Jr. | 227/8 |
| 5,579,977 | 12/1996 | Yang | 227/142 |

FOREIGN PATENT DOCUMENTS

| | | |
|---|---|---|
| 0 298 594 | 1/1989 | European Pat. Off. . |
| 30 29 196 | 2/1981 | Germany . |
| 2 053 069 | 2/1981 | United Kingdom . |
| 2 066 724 | 7/1981 | United Kingdom . |

*Primary Examiner*—Joseph J. Hail, III
*Assistant Examiner*—Jay Stelacone
*Attorney, Agent, or Firm*—Cushman Darby & Cushman IP Group of Pillsbury Madison & Sutro, LLP

[57] ABSTRACT

A safety mechanism for a nailing machine in which a start valve for a hammering mechanism is driven by cooperative action of operating a trigger lever and moving a contact arm to an uppermost point where it is pressed against a material to be nailed. The hammering mechanism for hammering a nail is supplied to a nose section arranged at a front end portion of a housing and is actuated by the start valve. The safety mechanism comprises: an arm body provided with the contact arm and being vertically movable along the nose section; a threaded member attached at an upper end portion of the arm body, the threaded member being rotatably and vertically movable; a push-up member positioned above the threaded member, the push-up member engaging with the threaded member to push up the trigger lever to make effective the operation of the trigger lever when the contact arm is moved to the uppermost point thereof; an adjust dial attached to the housing and positioned below the trigger lever, for rotating the threaded member; and a cover member covering the contact arm in part which is below the adjust dial and above the lower end of the arm body. The adjust dial may operate independently of the contact arm. The threaded member may have a hole for slidably receiving the receiving member.

6 Claims, 7 Drawing Sheets

SAFETY MECHANISM FOR NAILING MACHINE

BACKGROUND OF THE INVENTION

This invention relates to a nailing machine in which the cooperative action of the operation of a trigger lever and the operation of pushing a contact arm against a material to be nailed (hereinafter referred to merely as "a material", when applicable) operates a start valve, and more particularly to a safety mechanism for a nailing machine of this type which prevents the contact arm from being operated by mistake.

In general, in order to prevent a nailing machine from being operated erroneously and to operate it in safety, the nailing machine is started by the cooperative action of two operations, namely, the operation of a trigger lever and the operation of pushing a contact arm against a material to be nailed. And, by turning an adjust dial arranged which is generally provided below the trigger lever, the length of the contact arm is adjusted; that is, the nail hammering depth is adjusted.

On the other hand, the conventional adjust dial is operated in association with the contact arm. Hence, when, in hammering the nail, the contact arm is pushed against the material, the adjust dial is moved together with the contact arm, so that the finger may be caught between the adjust dial and the machine housing; or the contact arm may strike against an object or part other than the material, so that the nailing machine is erroneously operated; that is, the nail is ejected erroneously.

SUMMARY OF THE INVENTION

Accordingly, an object of the invention is to eliminate the above-described difficulties accompanying a conventional nailing machine. More specifically, an object of the invention is to provide a safety mechanism for a nailing machine which is so designed that the adjust dial is not moved following the contact arm, thereby to effectively prevent the accident that the finger is caught between the adjust dial and the machine housing, and the trouble that the nailing machine is operated by mistake.

To achieve the object, the present invention provides a safety mechanism for a nailing machine in which a start valve is driven by cooperative action of operating a trigger lever and moving a contact arm to an uppermost point so as to be pressed against a material to be nailed, and which a hammering mechanism for hammering a nail supplied to a nose section arranged at the front end portion of a housing is actuated by the start valve, the safety mechanism comprising: an arm body provided with the contact arm and being vertically movable along the nose section; a threaded member attached at an upper end portion of the arm body, the threaded member being helically movable; a push-up member positioned above the threaded member, the push-up member being cooperating with the threaded member to push up the trigger lever to make effective the operation of the trigger lever when the contact arm is moved to the uppermost point thereof; an adjust dial attached to the housing and positioned below the trigger lever, for rotating the threaded member; and a cover member covering the contact arm in part which is below the adjust dial and above the lower end of the arm body.

With the nailing machine of the invention, the start valve is operated by the cooperative action of the trigger lever operation and the contact-arm pressing operation, whereupon the hammering mechanism is started to hammer a nail supplied to the nose section. In this case, by rotating the adjust dial, the threaded member is helically rotated; that is, the latter is threadably moved with respect to the upper end of the arm body. Hence, the amount of protrusion of the lower end of the arm body from the front end of the nose section can be adjusted; that is, the nail hammering depth can be adjusted.

The adjust dial is provided on the side of the housing, and operates independently of the contact arm. This feature prevents the accident that, in driving the nail, the adjust dial is operated together with the contact arm, so that the finger is caught between the adjust dial and the housing.

Furthermore, the part of the contact arm which is below the adjust dial and above the lower end of the arm body is covered with the cover member. Hence, the adjust dial will never brought into contact with an object or part other than the material to be nailed. Therefore, the nailing machine of the invention will never be operated erroneously.

DETAILED DESCRIPTION OF THE PREFERRED EMBODIMENTS

Figure 1:
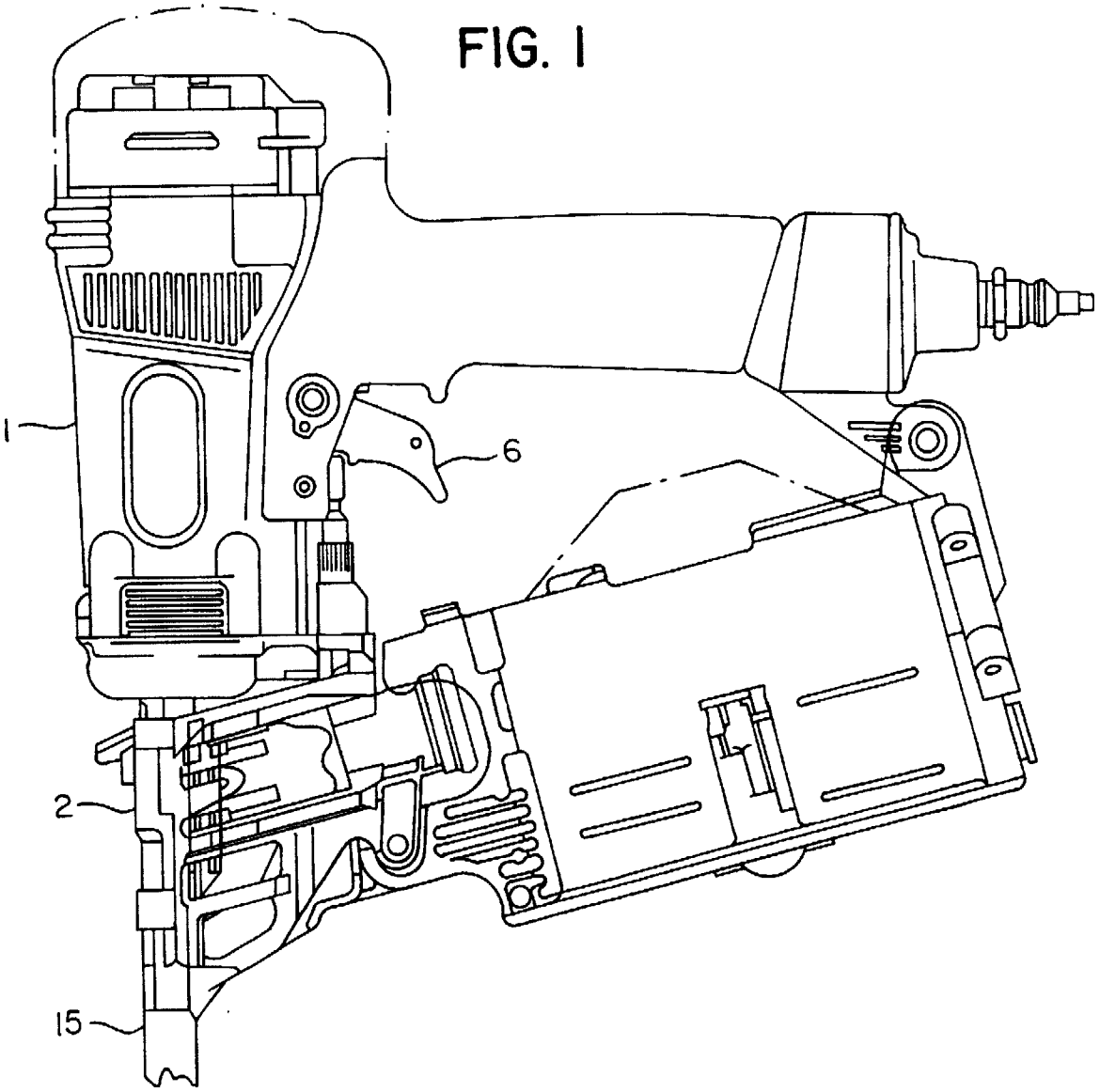
FIG. 1 is a side view showing a nailing machine according to the invention.
Figure 2:
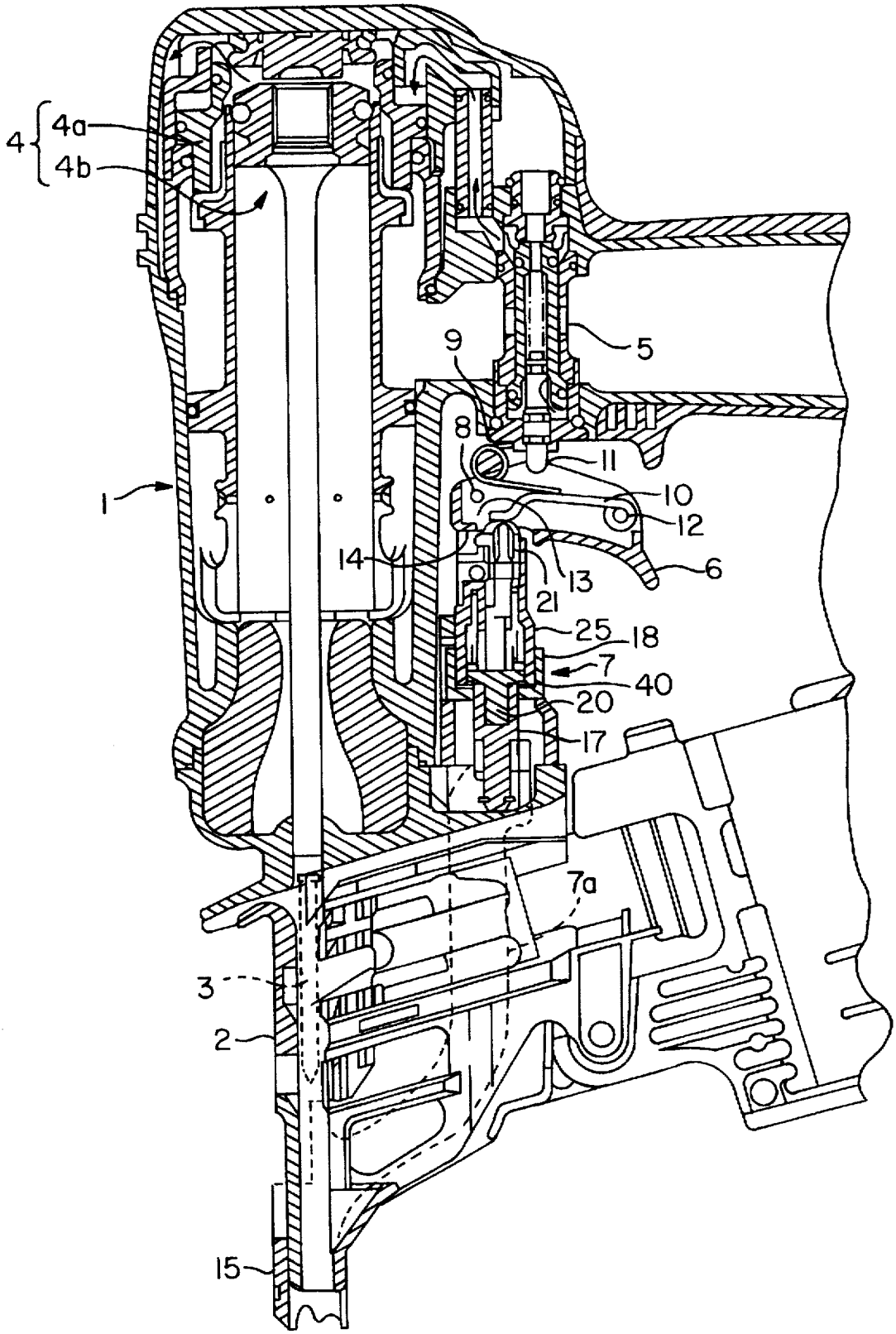
FIG. 2 is a longitudinal sectional view of the nailing machine of the invention.

FIGS. 1 and 2 shows a nailing machine according to the invention. The nailing machine comprises a housing 1, and a nose section 2 which is the front end portion of the housing 1, and a start valve 5 for activating a hammering mechanism 4 adapted to hammer a nail 3 supplied to the ejection opening of the nose section 2. The cooperative action of the operation of a trigger lever 6 and the operation of moving a contact arm 7 to the top dead point so as to be pressed against a material to be nailed (hereinafter referred to merely as "a material", when applicable) operates the start valve 5, thereby to control the hammering mechanism 4. The hammering mechanism 4 (including a hammering cylinder/piston unit 4*a*, and a head valve 4*b*), and the start valve 5 may be the same as those in a conventional air-pressure type nailing machine.

The trigger lever 6 is substantially U-shaped in section, and its one end portion is swingably mounted on a shaft 8 which is mounted on the housing 1. The trigger lever 6 is urged towards its original position by a spring 9. The trigger lever 6 includes two side walls between which a contact lever 10 is arranged. One end portion of the contact lever 10 extends towards the shaft 8 of the trigger lever 6, thus confronting with the valve stem 11 of the start valve 5. The other end portion of the contact lever 10 is swingably mounted on a rotary shaft 12 provided between the fingering main portions of the side walls of the trigger lever 6. The trigger lever 6 has an opening 13 in its bottom, and the edge of the opening 13 is employed as the locking section of the contact arm 7 (described later).

Figure 3:
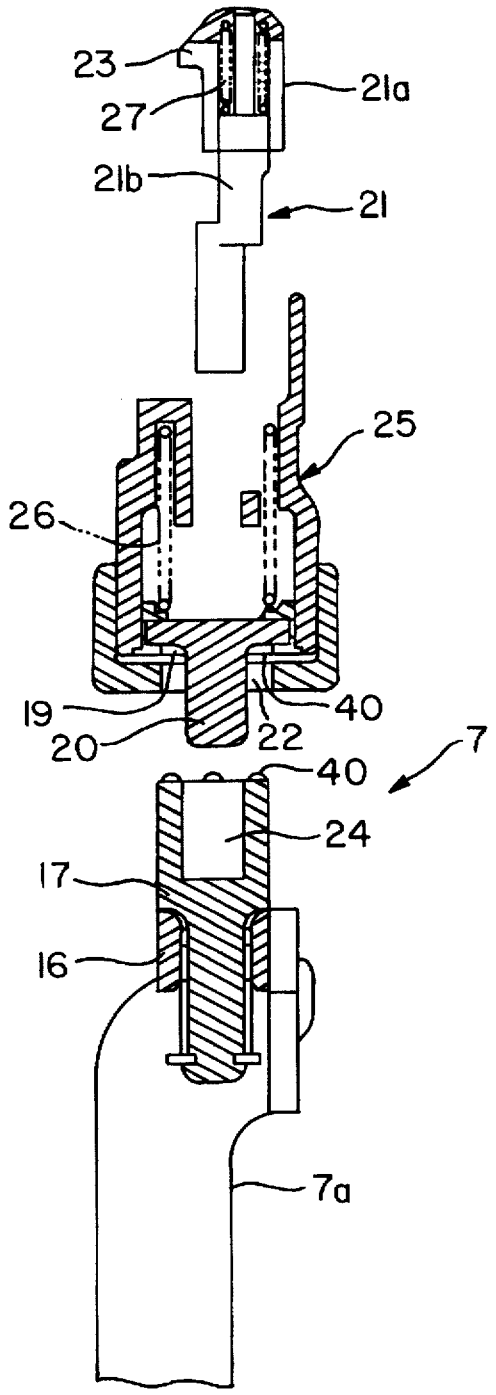
FIG. 3 is an exploded view showing components of a contact arm in the nailing machine of the invention.

In the housing 1, the contact arm 7 is vertically slidably arranged. The contact arm 7 is so designed that its lower end 15 is protrudable below the nose section 2. As shown in FIGS. 2 and 3, the contact arm 7 is formed by combining a plurality of members with the upper portion of an arm body 7*a*. The lower portion of the arm body 7*a* is arranged along the nose section 2, the middle portion thereof is bent, and the upper portion is confronted with the lower surface of the trigger lever 6. The upper portion of the contact arm 7 comprises: a threaded member 17 which is engaged with a nut 16 at the upper end of the arm body 7*a* in such a manner that the threaded member 17 is vertically movable; an adjust dial 18 for rotating the threaded member 17; a receiving member 20 having an engaging portion 19 which is abutted against the upper end of the threaded member, and is intermittently engaged with the threaded member 17 when the latter 17 is turned; and a push-up member 21 which is set on the receiving member 20, thus pushing up the trigger lever 6 when the contact arm 7 is moved to the top dead point.

The adjust dial 18 is fitted on the lower portion of a cylindrical guide member 25 in the housing 1.

The aforementioned threaded member 17 is inserted in a guide hole 22 formed on the adjust dial 18 at the center in such a manner that it is vertically slidable and is rotatable together with the adjust dial 18. Hence, as the adjust dial 18 is turned, the threaded member 17 is turned; that is, the threaded member 17 is helically moved with respect to the nut 16 at the upper end of the arm body 7*a*. As a result, the length of the contact arm 7 is changed, while the arm body 7*a* is moved vertically, so that the lower end thereof is shifted from the lower end of the nose section 2. Thus, the nail hammering depth can be adjusted. A slide hole 24 is formed in the upper portion of the threaded member 17.

The receiving member 20 is accommodated in the aforementioned guide member 25 in such a manner that it is vertically slidable in the latter 25 but not rotatable therein, and it is kept urged downwardly by a compression spring 26. In addition, the lower end portion of the receiving member 20 is accommodated in the slide hole 24 in such a manner that it is slidable in the slide hole 24. Since the receiving member 20 is inhibited from rotating with respect to the guide member 25, the threaded member 17 is rotated on the receiving member 20. Hence, when the threaded member 17 is turned by turning the adjust dial 18, the engaging portion of the threaded member 17 is snugly engaged with the engaging portion 19 of the receiving member 20, thus regulating the rotation; that is, the adjust dial 18 is prevented from being freely turned. The engagement of the threaded member 17 with the receiving member 20 may be obtained by means of a click mechanism 40 comprising a recess and a protrusion which are snugly engaged with each other when the threaded member is rotated by rotating the adjust dial.

The aforementioned push-up member 21 is designed as follows: A push-up rod 21*b* is slidably inserted into a cylindrical slide piece 21*a*, and it is kept urged downwardly by a compression spring 27. The slide piece 21*a* has a locking jaw 23 at the upper end. The push-up member 21 is slidably set in the guide member 25 in such a manner that its upper portion is protruded from the guide member 25. The push-up member 21 is so arranged that it can be inserted into the opening 13 of the aforementioned trigger lever 6. When, after the contact arm 7 is moved upwardly so that the push-up member 21 enters the opening 13 of the trigger lever, the trigger lever 6 is operated (pulled), the locking jaw 23 of the slide piece 21*a* is locked to the locking portion 14 of the trigger lever 6.

A spring 26 is provided near the trigger lever 6, to urge the trigger lever 6 towards the original position and to urge the push-up member 21 so that the lower end of the push-up rod 21*b* abuts against the upper surface of the receiving member 20.

Figure 4:
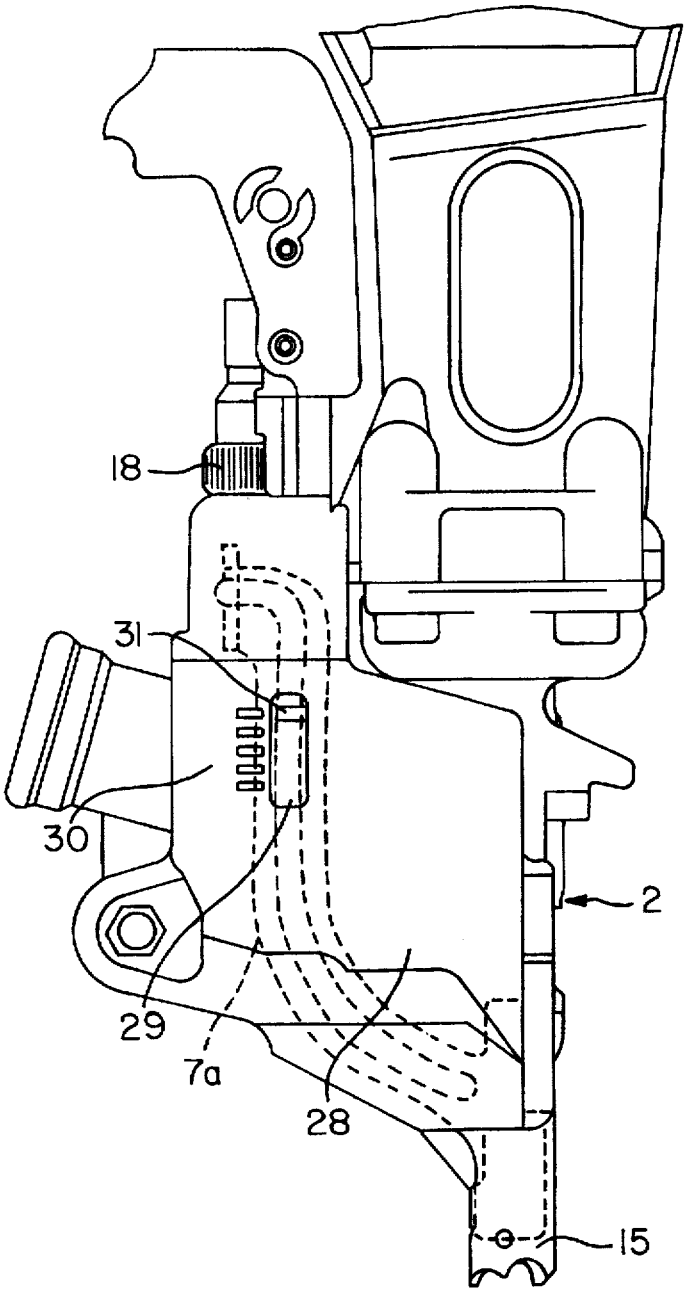
FIG. 4 is side view showing an arm body covered with a cover member in the nailing machine of the invention.
Figure 5:
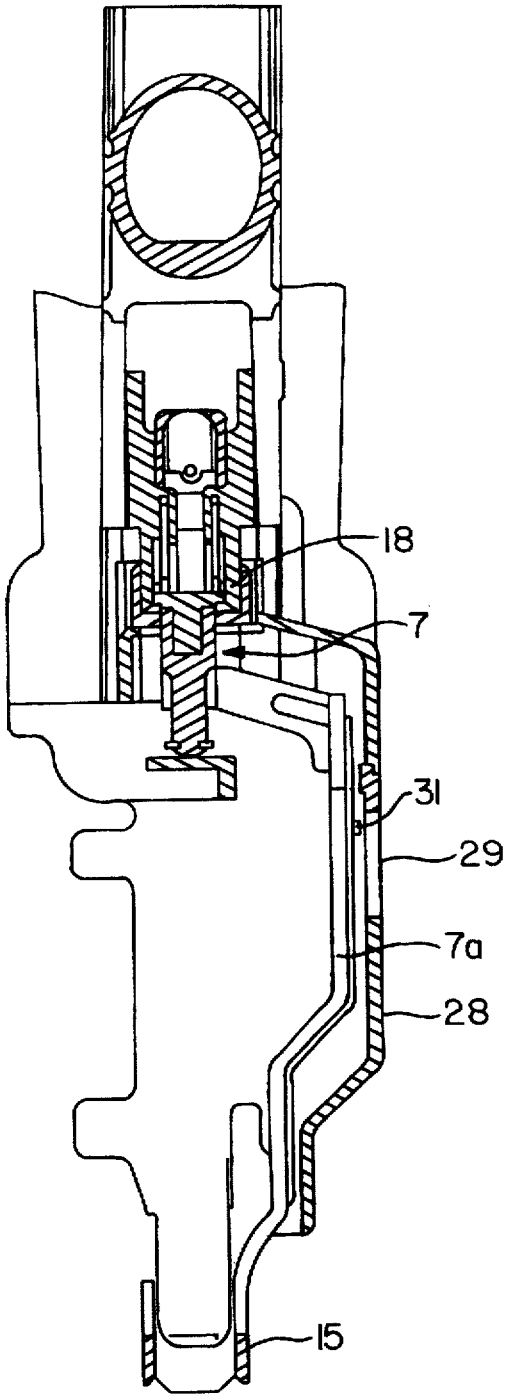
FIG. 5 is a sectional view showing the arm body and the contact arm in the nailing machine of the invention.

As shown in FIGS. 4 and 5, the part of the contact arm 7 which is below the adjust dial 18 and above the lower end of the arm body 7*a* is covered with a cover member 28. The latter 28 has an opening 29. With respect to the opening 29, a scale 30 and an index 31 are provided on the cover member 28 and the arm body 27, respectively, to indicate the amount of adjustment of the contact arm 7 which is made with the adjust dial 18.

Figure 6:
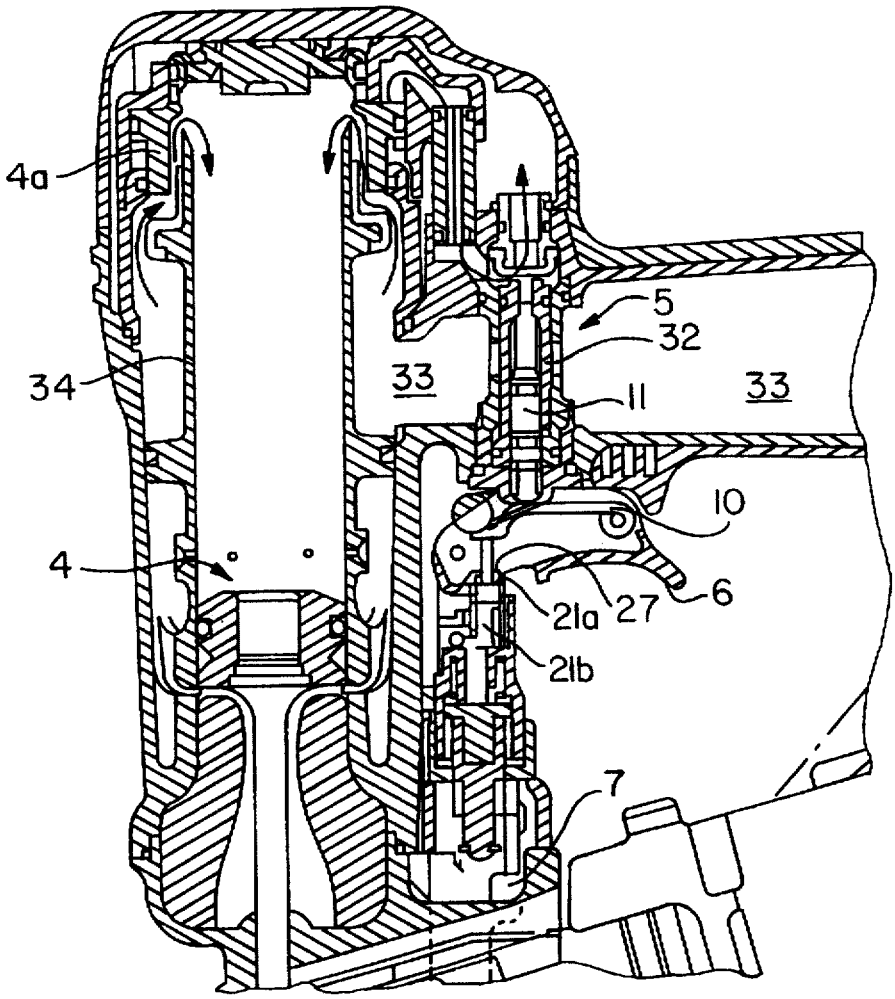
FIG. 6 shows the operation of the nailing machine in a continuous nail-hammering mode.
Figure 7:
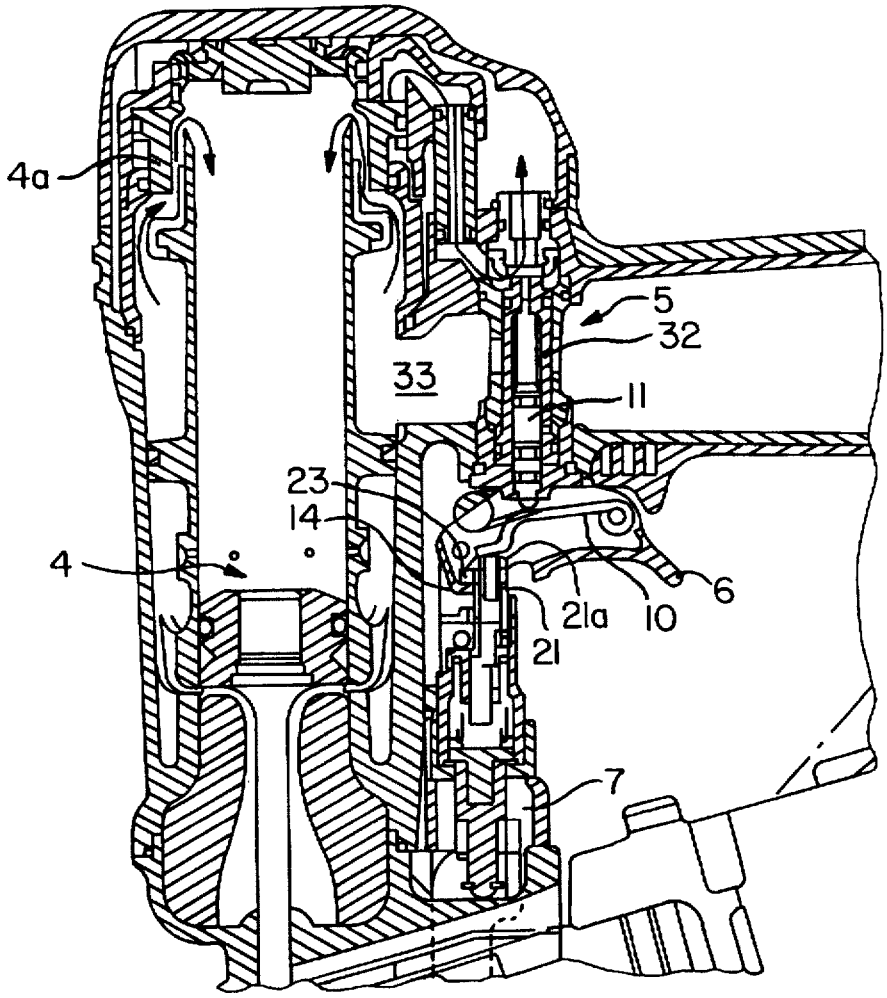
FIG. 7 shows the operation of the nailing machine in a single nail-hammering mode.

In the nailing machine thus constructed, first the trigger lever 6 is operated, and then the contact arm 7 is moved to the top dead point being pressed against the material to be nailed. As a result, as shown in FIG. 6, the push-up rod 21*b* is moved upwardly against the compression spring 27 of the slide piece 27 to push up the contact lever 20, whereby the valve stem 11 is moved upwardly. Hence, a pilot valve 32 is moved downwardly to turn on the start valve 5, and the head valve 4*b* is opened to supply compressed air from an air chamber 33 into a hammering cylinder 34. As a result, the hammering cylinder/piston unit 4*a* is operated to drive the nail into the material. When, after the nail driving operation, the nailing machine is left from the material to move the contact arm 7 downwardly with the trigger lever kept pulled, the contact lever 10 is swung to the bottom dead point as shown in FIG. 2, so that the start valve 5 is turned off, and the hammering cylinder/piston unit 4*a* is placed in its initial state. When, under this condition, the contact arm 7 is pressed against the material, the start valve 5 is turned on again in the above-described manner, and the hammering cylinder/piston unit 4*a* is driven. Thus, nails can be driven into the material continuously On the other hand, as shown in FIG. 7, with the contact arm 7 pressed against the material, one end portion of the contact lever 10 is pushed up with the push-up member 21 to swing the contact lever 10. Under this condition, the trigger lever 6 is pulled, so that the contact lever 10 is swung, and the start valve 5 is turned on. As a result, the hammering mechanism 4 is driven. Thus, the nailing operation is carried out. When, after the nailing operation, it is tried to release the contact arm 7 to return the latter 7 downwardly with the trigger lever 6 kept pulled, then since the locking jaw 23 of the slide piece 31*a* is locked to the locking portion 14 of the trigger lever 6, the downward return of the contact arm 7 is prevented, so that the push-up member 21 is held at the upper position. Hence, it is impossible for the contact lever 10 to return to its initial position, and the valve stem 11 is held between the top and bottom dead points, and the start valved 5 is not turned off. Therefore, even if the contact arm 7 is pressed against the material again, the hammering mechanism 4 is not driven. When the trigger lever 6 is released, the locking jaw 23 of the slide piece 21*a* is disengaged from the locking portion 14 of the trigger lever 6, so that the contact lever 10 is further swung downwardly. Hence, the start valve 5 is turned off. Thus, the initial state as shown in FIG. 2 is obtained again. By performing the above-described operation repeatedly, single nail-hammering operations are carried out.

When, in the nailing machine thus organized, the adjust dial 18 is turned, the threaded member 17 is also turned, thus being threadably moved with respect to the nut 16 at the upper end of the arm body 7*a*. Hence, the amount of protrusion of the lower end of the arm body 7*a* from the end of the nose section 2 can be adjusted; that is, the nail hammering depth can be adjusted. The amount of adjustment can be visually determined with the scale 30 and the index 31.

The adjust dial 18 is provided on the housing 1, and is operated independently of the contact arm 7. This feature prevents the accident that, in driving the nail, the adjust dial 18 is operated together with the contact arm 7, as a result of which the finger is caught between the adjust dial 18 and the housing.

Furthermore, the part of the contact arm 7 which is below the adjust dial 18 and above the lower end of the arm body *7a* is covered with the cover member 28. Hence, the adjust dial 18 will never brought into contact with an objects or part other than the material to be nailed. This fact eliminates the difficulty accompanying the conventional nailing machine that the operation of the latter is erroneous.

What is claimed is:

1. A safety mechanism for a nailing machne in which a start valve is driven by cooperative action of operating a trigger lever and moving a contact arm to an uppermost point where it is pressed against a material to be nailed, and which a hammering mechanism for hammering a nail supplied to a nose section arranged at a front end portion of a housing is actuated by the start valve, the safety mechanism comprising:

an arm body provided with the contact arm and being vertically movable along the nose section;

a threaded member attached to an upper end portion of the arm body, the threaded member being rotatably and vertically movable with respect to the arm body;

a push-up member positioned above the threaded member, the push-up member engaging with the threaded member to push up the trigger lever to make effective the operation of the trigger lever when the contact arm is moved to the uppermost point thereof;

an adjust dial rotatably attached to the housing and positioned below the trigger lever, for rotating the threaded member, and which operates independently of the contact arm; and a cover member covering the contact arm in part which is below the adjust dial and above a lower end of the arm body.

2. The safety mechanism according to claim 1, further comprising:

a receiving member engaged with the threaded member;

a guide member slidably accommodating the receiving member and slidably accommodating the push-up member, wherein the receiving member is prohibited from rotating with respect to the guide member;

a spring provided between the receiving member and the guide member to urge the receiving member toward the threaded members.

3. The safety mechanism according to claim 2, further comprising:

a click mechanism provided between the threaded member and the receiving member.

4. The safety mechanism according to claim 2, wherein the threaded member has a hole for slidably receiving the receiving member.

5. The safety mechanism according to claim 2, wherein the threaded member is slidably inserted into the adjust dial, and the threaded member is rotated in accordance with the adjust dial.

6. A safety mechanism for a nailing machine in which a start valve is driven by cooperative action of operating a trigger lever and moving a contact arm to an uppermost point where it is pressed against a material to be nailed, and which a hammering mechanism for hammering a nail supplied to a nose section arranged at a front end portion of a housing is actuated by the start valve, the safety mechanism comprising:

an arm body provided with the contact arm and being vertically movable along the nose section;

a threaded member attached to an upper end portion of the arm body, the threaded member being rotatably and vertically movable with respect to the arm body;

a push-up member positioned above the threaded member, the push-up member engaging with the threaded member to push up the trigger lever to make effective the operation of the trigger lever when the contact arm is moved to the uppermost point thereof;

an adjust dial rotatably attached to the housing and positioned below the trigger lever, for rotating the threaded member, a cover member covering the contact arm in part which is below the adjust dial and above lower end of the arm body;

a receiving member engaged with the threaded member;

a guide member slidably accommodating the receiving member and slidably accommodating the push-up member, wherein the receiving member is prohibited from rotating with respect to the guide member;

a spring provided between the receiving member and the guide member to urge the receiving member toward the threaded member; and the threaded member has a hole for slidably receiving the receiving member.

* * * * *